US007416452B1

(12) United States Patent
Sabo

(10) Patent No.: US 7,416,452 B1
(45) Date of Patent: Aug. 26, 2008

(54) ELECTRICAL CONNECTOR

(75) Inventor: James M. Sabo, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/724,462

(22) Filed: Mar. 15, 2007

(51) Int. Cl.
*H01R 24/00* (2006.01)

(52) U.S. Cl. ..... 439/631; 439/62; 439/65; 439/377

(58) Field of Classification Search ..... 439/631, 439/637, 65, 377, 59, 62
See application file for complete search history.

(56) References Cited

U.S. PATENT DOCUMENTS 3,941,448 A * 3/1976 Evans ..... 439/493
4,400,049 A * 8/1983 Schuck ..... 439/631
4,660,920 A * 4/1987 Shibano ..... 439/631
4,717,218 A * 1/1988 Ratcliff ..... 439/59
5,478,247 A 12/1995 Chen
5,531,615 A * 7/1996 Irlbeck et al. ..... 439/631
5,928,036 A * 7/1999 Thrush ..... 439/631
6,010,368 A * 1/2000 Tai ..... 439/637
6,551,138 B2 * 4/2003 Ruque ..... 439/607
6,685,485 B2 * 2/2004 Korsunsky et al. ..... 439/79
6,722,915 B1 * 4/2004 McAlonis et al. ..... 439/498
6,824,413 B1 * 11/2004 Shipe et al. ..... 439/326
7,125,286 B2 * 10/2006 Wang et al. ..... 439/637
7,188,408 B2 * 3/2007 Korsunsky et al. ..... 29/831
2003/0181079 A1 * 9/2003 Korsunsky et al. ..... 439/79

FOREIGN PATENT DOCUMENTS

CN 2845210 Y 12/2006

* cited by examiner

*Primary Examiner*—Neil Abrams
*Assistant Examiner*—Harshad C Patel
(74) *Attorney, Agent, or Firm*—Wei Te Chung

(57) ABSTRACT

An electrical connector includes an elongated housing having a daughter-card receiving on a first surface and mother-card receiving channel on a second surface thereof and extending along a lengthwise direction for receiving a daughter-card member and mother-card member. Respective daughter-card engagement slots and mother-card member slots are defined on opposed ends of housing, each slot extending from the first surface and second surface and along a transverse direction. The slots are laterally separated from the receiving channel for receiving lateral edge portions of the daughter-card member. A central line of each slot is aligned with a central line of the receiving channel in the lengthwise direction such that configuration of the slots will allow for the daughter card member and mother-card member to be held coplanar with respect to a middle plane of the channel, thereby establishing an effective electrical connection between the connector and the daughter-card member and the mother-card member.

9 Claims, 5 Drawing Sheets

ELECTRICAL CONNECTOR

BACKGROUND OF THE INVENTION

1. Field of the Invention

The present invention relates to the art of electrical connectors, and more particularly to an electrical connector for electrically connecting together circuit boards, such as a mother-card member and a daughter-card member.

2. Description of the Related Art

Chinese Pat. No. 2845210 issued to Cai Zhou-Xuan on Dec. 6, 2006 discloses a related conventional electrical connector normally named as "a card-edge connector". The card edge connector includes an insulative elongated housing defining a card member receiving channel extending from a surface of the housing and along a lengthwise direction. A plurality of terminals is arranged in series and on the housing along opposed lengthwise edges of the card member receiving channel. The terminals include resilient arms defining opposed contact sections extending into the card member receiving channel for resiliently clipping a mating edge of the card member and for electrically contacting soldering pads disposed along the mating edge of the card member when the card member is inserted into the card member receiving channel of the housing. The housing may be provided with a latching device attached thereto, the latching device generally including a positioning slot at one side thereof for a lateral edge portion of the card member to be received therein so as to hold the card member in position with respect to the electrical connector. For most instances, this arrangement of the positioning slot may be such that when the card member is secured onto the electrical connector by inserting the lateral edge portion of the card member into the positioning slot, the mating edge of the card member, from a top view thereof, may be displaced with respect to a central line of the card member receiving channel of the housing along the lengthwise direction of the housing. Thus, there may be some of soldering pads on the mating edge of the card member that are not in direct contact with the terminals of the housing, thereby resulting in electrical connection failure at locations of those soldering pads.

U.S. Pat. No. 5,478,247 issued to Chou Lin Chen on Dec. 26, 1995 discloses another related card-edge connector. This card-edge connector also includes a card member receiving channel extending from a surface thereof and along a lengthwise direction for engaging a main edge of a card member. This configuration may also enable the card member to be displaced with respect to a middle plane of the card member receiving channel of the connector, thereby having a same problem described above.

Therefore, there is a need to provide an electrical connector to resolve the above-mentioned problem.

SUMMARY OF THE INVENTION

An electrical connector according to an embodiment of the present invention includes an elongated housing formed from an insulative material and defining a lengthwise direction and a transverse direction. The housing has a first surface and a second surface, and includes a daughter-card receiving channel on the first surface of the housing and extending along the lengthwise direction, with the daughter-card receiving channel adapted for receiving a mating edge of a daughter-card member. A mother-card receiving channel is defined on the second surface of the housing and extending along the lengthwise direction, with the mother-card receiving channel adapted for receiving a mating edge of a mother-card member. Respective daughter-card engagement slots are defined on opposed ends of the housing, each daughter-card engagement slot extending from the first surface and along the transverse direction. The daughter-card engagement slots are laterally separated from the daughter-card receiving channel for receiving therein respective lateral edge portions of the daughter-card member, wherein a central line of each daughter-card engagement slot is aligned with a central line of the daughter-card receiving channel in the lengthwise direction of the housing. This configuration of the daughter-card engagement slots will allow for the daughter-card member to be held coplanar with respect to a middle plane of the daughter-card receiving channel where terminals are set to extend thereinto for being in direct contact with soldering pads of the daughter-card member, thereby establishing an effective electrical connection between the electrical connector and the daughter-card member.

An electrical connector according to an embodiment of the present invention includes an elongated housing formed from an insulative material and defining a lengthwise direction and a transverse direction perpendicular to each other. The housing has a first surface and a second surface, and includes a daughter-card receiving channel on the first surface of the housing and extending along the lengthwise direction, with the daughter-card receiving channel adapted for receiving a mating edge of a daughter-card member. A mother-card receiving channel is defined on the second surface of the housing and extending along the lengthwise direction, with the mother-card receiving channel adapted for receiving a mating edge of a mother-card member. Respective mother-card engagement slots are defined on opposed ends of the housing, each mother-card engagement slot extending from said second surface and along the transverse direction. The mother-card engagement slots are laterally in communication with the mother-card receiving channel. Each mother-card engagement slot is defined by a pair of free extension legs for receiving therein respective lateral edge portions of the mother-card member. A central line of each mother-card engagement slot is aligned with a central line of the mother-card receiving channel in the lengthwise direction of the housing. This configuration of the mother-card engagement slots will allow for the mother-card member to be held coplanar with respect to a middle plane of the mother-card receiving channel where terminals are set to extend thereinto for being in direct contact with soldering pads of the daughter-card member, thereby establishing an effective electrical connection between the electrical connector and the mother-card member.

An electrical connector according to an embodiment of the present invention includes an elongated housing formed from an insulative material and defining a lengthwise direction and a transverse direction perpendicular to each other. The housing has opposed first and second surfaces, and includes a daughter-card receiving channel on the first surface of the housing and extending along the lengthwise direction, the daughter-card receiving channel adapted for receiving a mating edge of a daughter-card member. A mother-card receiving channel is defined on the second surface of the housing and extending along the lengthwise direction, the mother-card receiving channel adapted for receiving a mating edge of a mother-card member. Respective daughter-card engagement slots are defined on opposed ends of the housing, each daughter-card engagement slot extending from the first surface and along the transverse direction, the daughter-card engagement slots adapted for receiving therein respective lateral edge portions of the daughter-card member, wherein a central line of each daughter-card engagement slot is aligned with a central line of the daughter-card receiving channel in the lengthwise direction of the housing. Respective mother-card engagement slots are defined on opposed ends of the housing, each mother-card engagement slot extending from the second surface and along the transverse direction, the mother-card engagement slots adapted for receiving therein respective lateral edge portions of the mother-card member, wherein a central line of each said mother-card engagement slot is aligned with a central line of the mother-card receiving channel in the lengthwise direction of the housing. A central line of each mother-card engagement slot is aligned with a central line of each daughter-card engagement slot in the transverse direction of the housing. This configuration of the card engagement slots (the mother-card engagement slots or the daughter-card engagement slots) will allow for the card member (the mother-card member or the daughter-card member) to be held coplanar with respect to the middle plane of the card receiving channel where the terminals are set to extend thereinto for being in direct contact with the soldering pads of the card member, and also for the mother-card member and the daughter-card member to be held in a common plane.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
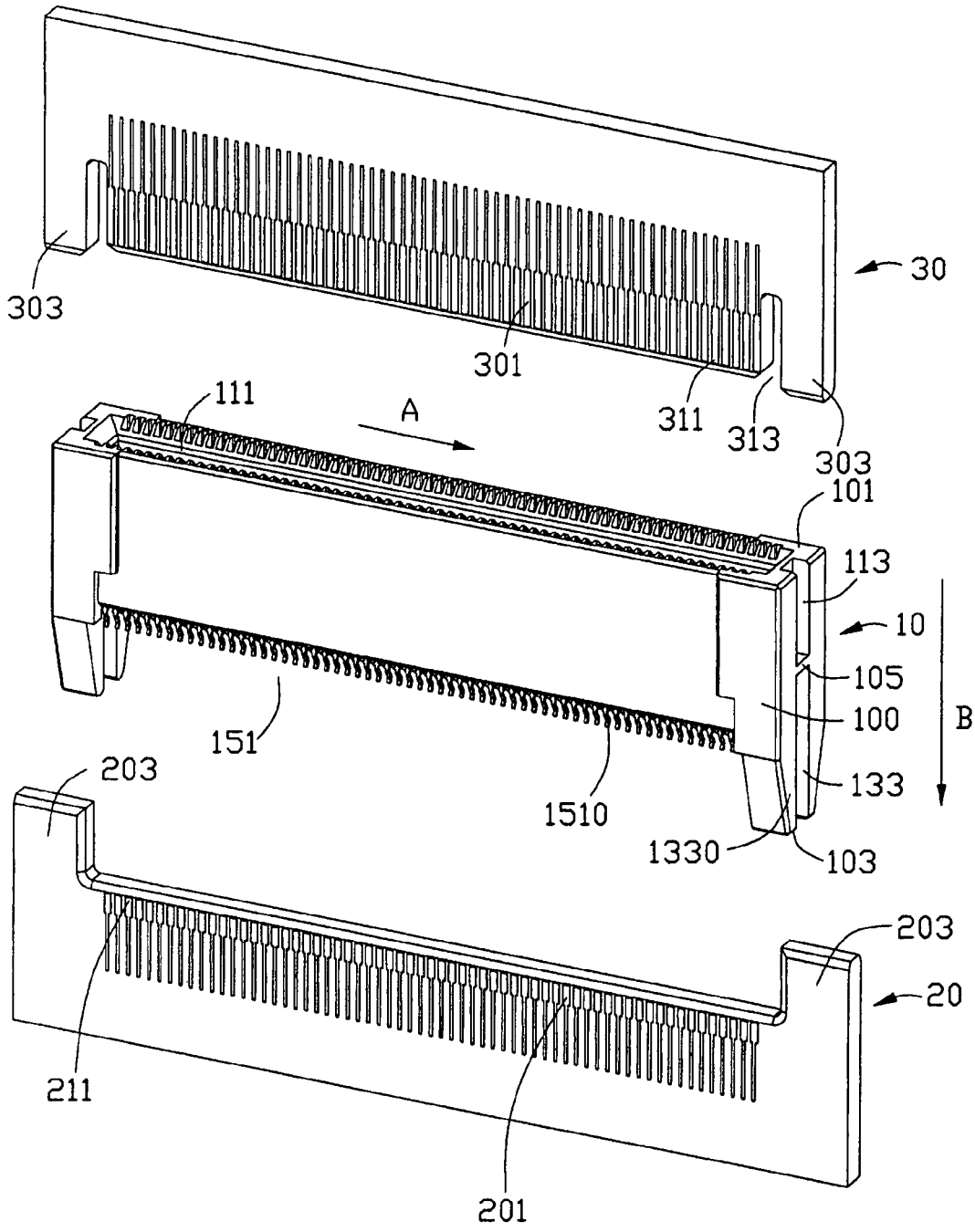
FIG. 1 is an exploded, perspective view of an electrical connector assembly including thereof an electrical connector, a daughter-card member and a mother-card member according to an embodiment of the present invention.

Referring to FIGS. 1 to 5, an electrical connector 10 for electrically connecting with two circuit boards, generally a parallel arrangement of a mother-card member 20 and a daughter-card member 30, is shown according to a preferred embodiment of the present invention. In this embodiment, the mother-card member 20 defines a mating edge 201 where a plurality of soldering pads 211 is disposed thereon, and two lateral edge portions 203 extending outwardly with a predetermined distance from the mating edge 201 of the mother-card member 20. In other words, the mating edge 201 is recessed with respect to the lateral edge portions 203 of the mother-card member 20. The daughter-card member 30 defines a mating edge 301 where a plurality of soldering pads 311 is disposed thereon, and two lateral edge portions 303 on opposed ends of the mating edge 301 of the daughter-card member 30. The lateral edge portions 303 are laterally spaced from the mating edge 301 by elongated slots 313 defined therebetween.

The electrical connector 10 includes an elongated housing 100 formed from an insulative material and defining thereof a lengthwise direction A and a transverse direction B perpendicular to each other. The housing 100 has thereof a first mating surface 101 and a second mating surface 103. In this embodiment, the first surface 101 and the second surface 103 are arranged in opposed relationship. However, in other embodiments, the first surface 101 and the second surface 103 may be of any suitable configuration, such as the second surface 103 arranged perpendicular to the first surface 101, and etc.

The first surface 101 includes a daughter-card receiving channel 111 extending along the lengthwise direction of the housing 100 for receiving the mating edge 301 of the daughter-card member 30, with respective daughter-card engagement slots 113 defined on opposed ends of the housing 100. Each of the daughter-card engagement slots 113 extends from the first surface 101 and along the transverse direction B of the housing 100. In this embodiment, each daughter-card engagement slot 113 is also disposed on a surface perpendicular to any of the opposed first and second surfaces 101 and 103. The daughter-card engagement slots 113 are laterally separated from the daughter-card receiving channel 111 in the lengthwise direction for receiving therein the respective lateral edge portions 303 of the daughter-card member 30. A central line of each daughter-card engagement slots 113 is aligned with a central line of the daughter-card receiving channel 111 in the lengthwise direction of the housing 100 such that when the daughter-card member 30 is inserted into the daughter-card receiving channel 111 by the lateral edge portions 303 of the daughter-card member 30 engagably sliding on the opposed daughter-card engagement slots 113, the mating edge 301 of the daughter-card member 30 is held coplanar with respect to a middle plane of the daughter-card receiving channel 111 in the lengthwise direction A of the housing 100. Thus, the soldering pads 311 disposed on the mating edge 301 of the daughter-card member 30 are held in direct contact with terminals (not shown) that extend into the daughter-card receiving channel 111, thereby establishing effective electrical connection between the electrical connector 10 and the daughter-card member 30.

The second surface 103 includes a mother-card receiving channel 151 extending along the lengthwise direction A of the housing 100 for receiving the mating edge 201 of the mother-card member 20, with respective mother-card engagement slots 133 defined on opposed ends of the housing 100. Each of the mother-card engagement slots 133 extends from the second surface 103 and along the transverse direction B of the housing 100. The mother-card engagement slots 133 are laterally in communication with the mother-card receiving channel 151. In this embodiment, each mother-card engagement slot 133 is defined by a pair of free extension legs 1330, which are spaced apart from each other, for receiving therein the respective lateral edge portions 203 of the mother-card member 20. A central line of each mother-card engagement slot 133 is aligned with a central line of the mother-card receiving channel 151 along the lengthwise direction A of the housing 100 such that when the mother-card member 20 is inserted into the mother-card receiving channel 151 by the pair of free extension legs 1330 cooperatively engaging against opposed surfaces of the respective lateral edge portions 203 of the mother-card member 20, the mating edge 201 of the mother-card member 20 is held coplanar with respect to a middle plane of the mother-card receiving channel along the lengthwise direction A of the housing 100. Thus, the soldering pads 211 disposed on the mating edge 201 of the mother-card member 20 are held in direct contact with terminals 1510 that extend into the mother-card receiving channel 151, thereby establishing effective electrical connection between the electrical connector 10 and the mother-card member 20. In this embodiment, the central line of each mother-card engagement slot 133 is also aligned with the central line of each daughter-card engagement slot 113 in the transverse direction B such that the daughter-card member 30 and the mother-card member 20, when inserted into the electrical connector 10, are held in a common plane with each other. Thus, this configuration will assure a short electrical connection path is formed between the daughter-card member 30 and the mother-card member 20.

In this embodiment, each mother-card engagement slot 133 is physically separated from each daughter-card engagement slot 113 in the transverse direction B of the housing 100 by a stopping wall 105 formed therebetween. This shopping wall 105 forms a physical stop for the electrical connector 10 with respect to the daughter-card member 30 or the mother-card member 20.

Figure 2:
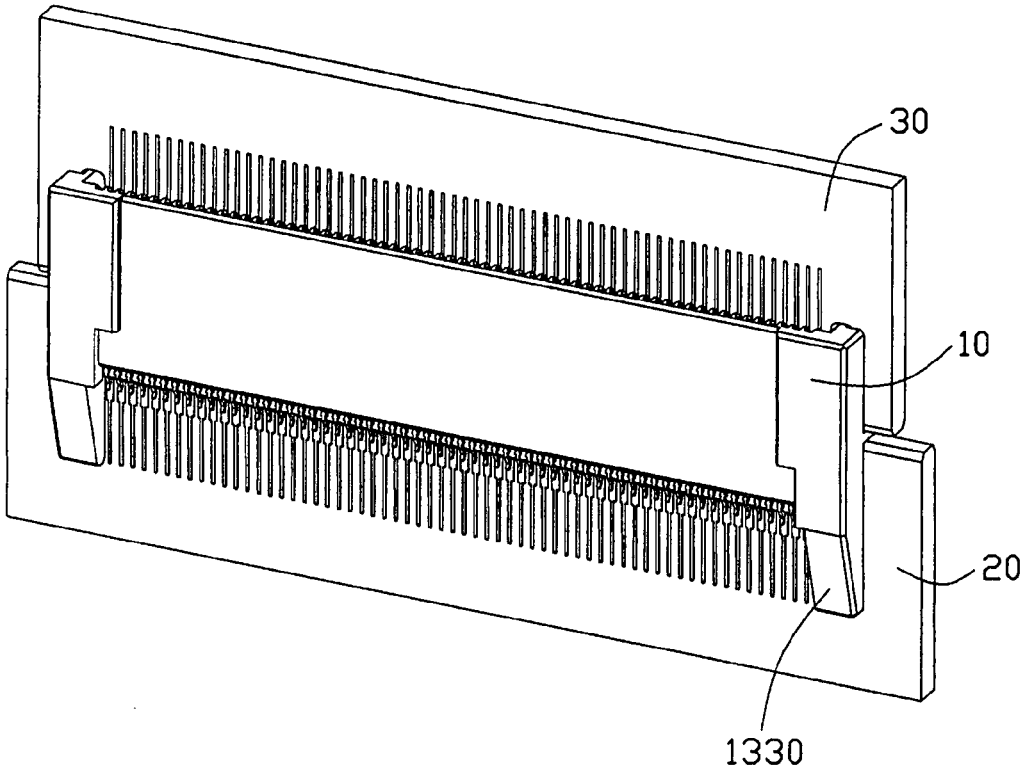
FIG. 2 is an assembled, perspective view of the electrical connector assembly of FIG. 1.
Figure 3:
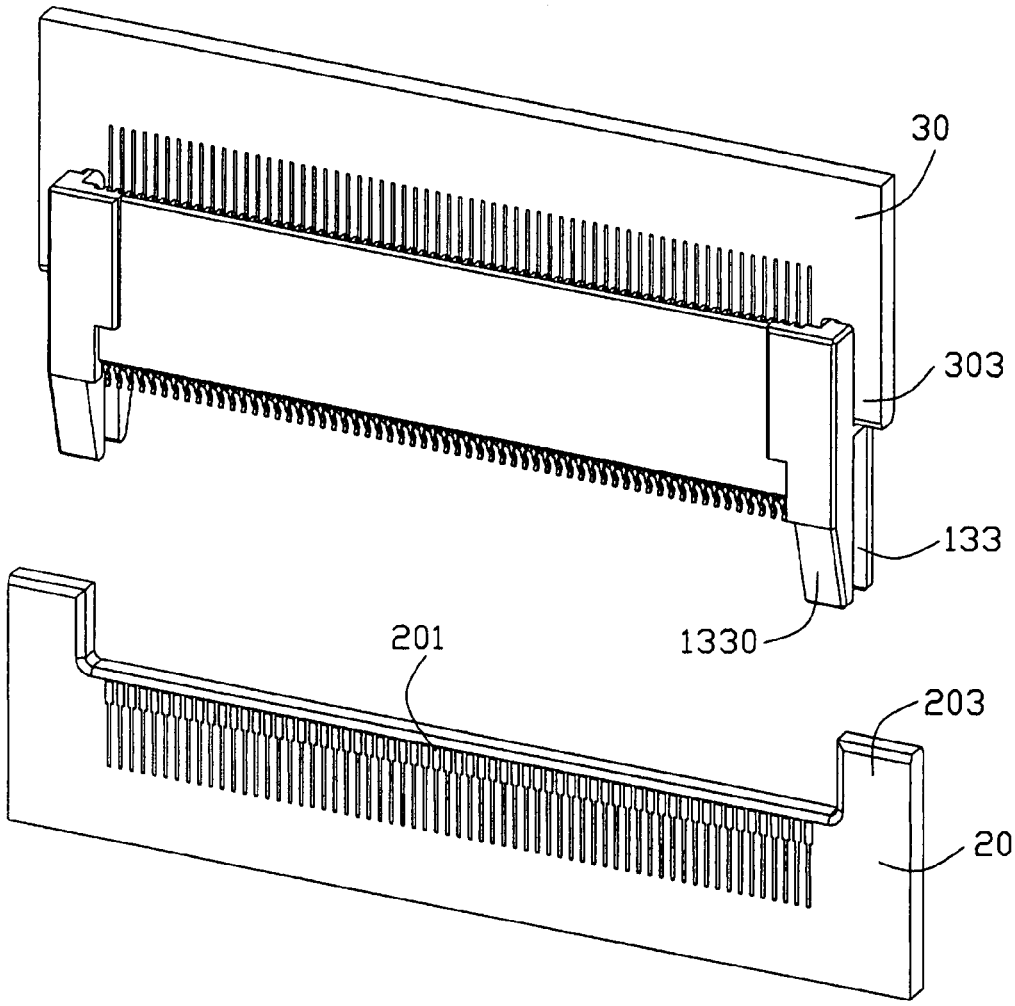
FIG. 3 is a perspective view of the electrical connector assembly of FIG. 1, showing the mother-card member unassembled onto the electrical connector and the daughter-card member assembled onto the electrical connector.
Figure 4:
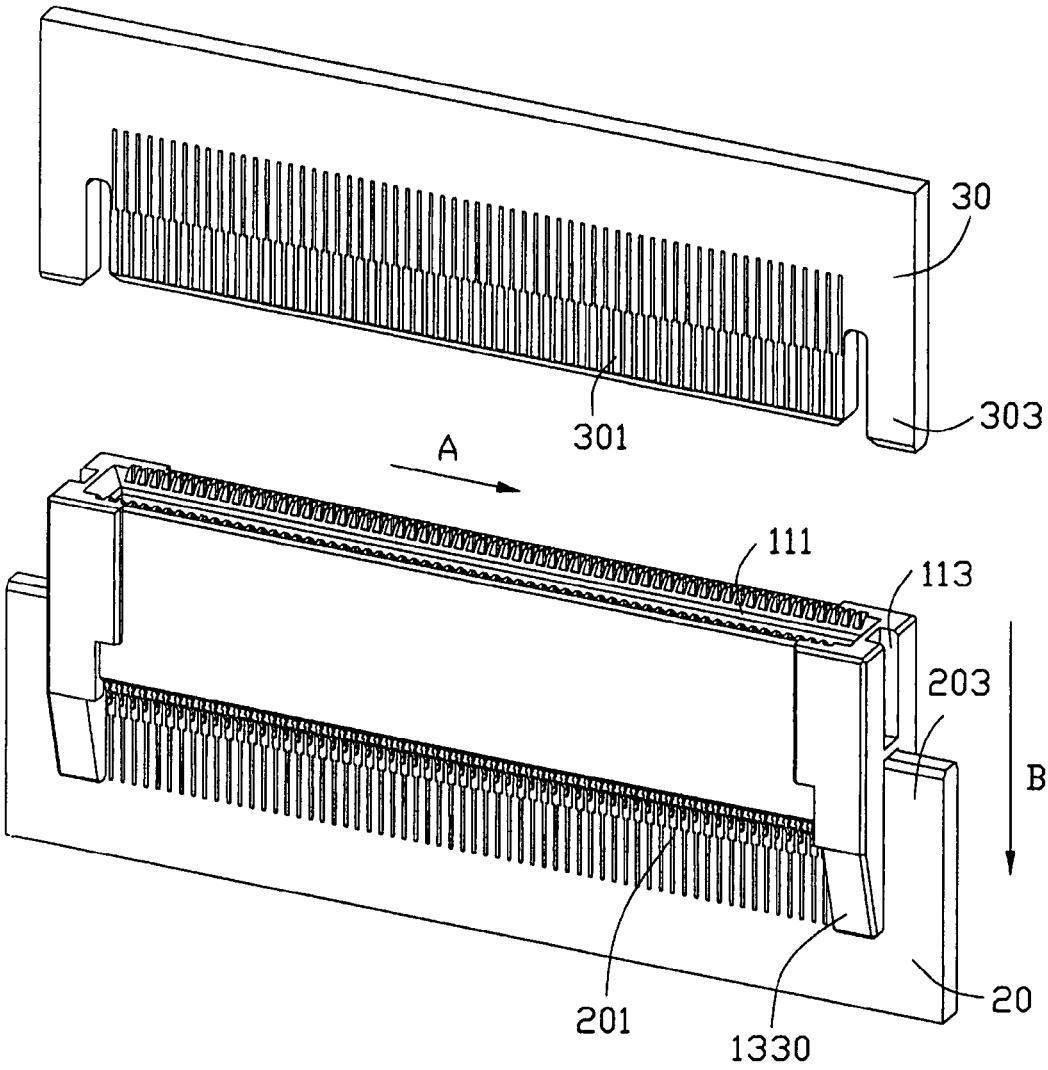
FIG. 4 is a perspective view of the electrical connector assembly of FIG. 1, showing the mother-card member assembled onto the electrical connector and the daughter-card member unassembled onto the electrical connector.
Figure 5:
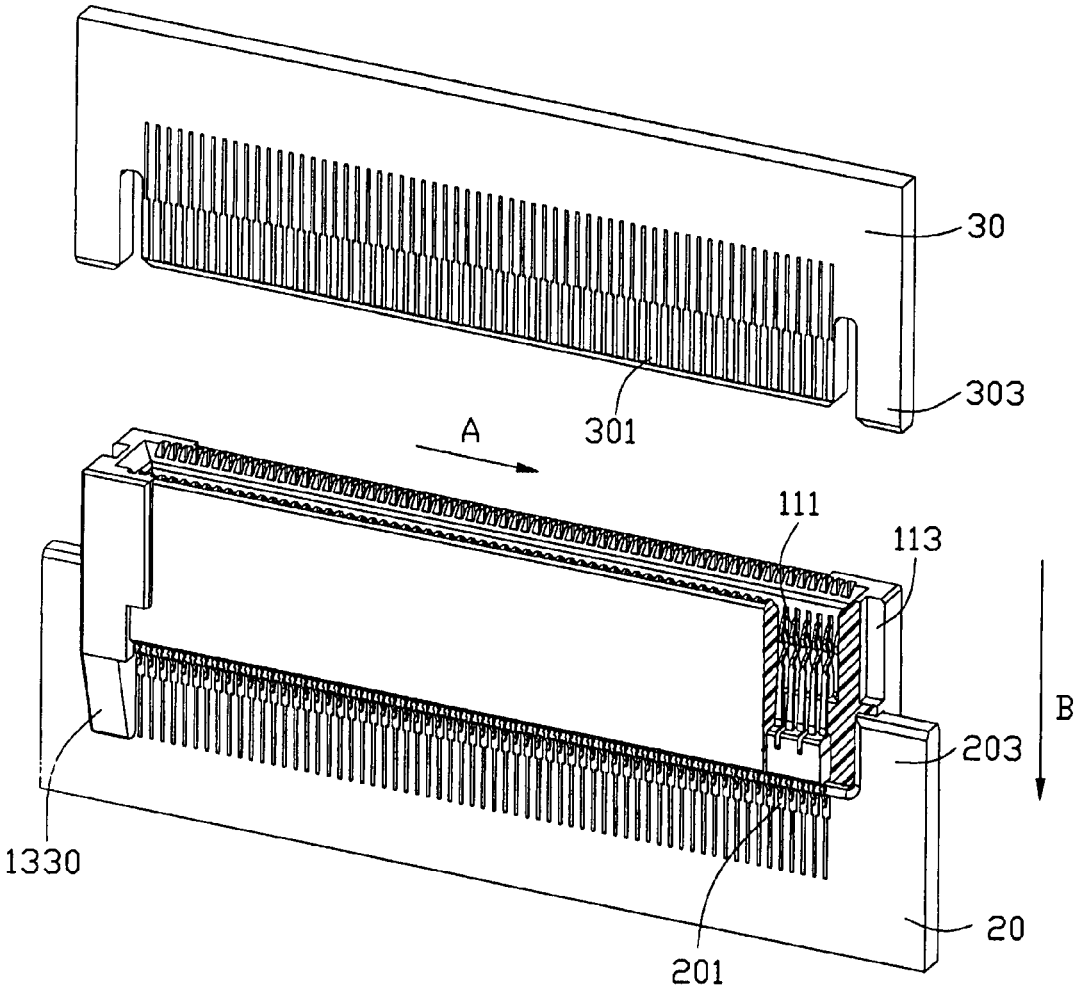
FIG. 5 is a partly cross-sectional view of the electrical connector assembly of FIG. 4.

Referring to FIGS. 1 and 2, in assembly, the daughter-card member 30 is assembled onto the electrical connector 10 by the mating edge 301 of the daughter-card member 30 inserted into the daughter-card receiving channel 111, and the lateral edge portions 303 of the daughter-card member 30 slidably engaged onto the daughter-card engagement slots 113. The mother-card member 20 is assembled onto the electrical connector 10 by the mating edge 201 of the mother-card member 20 inserted into the mother-card receiving channel 151, and each lateral edge portion 203 of the mother-card member 20 engaged by each pair of free extension legs 1330. From the above, it can be seen that this configuration of the card engagement slots (the mother-card engagement slots 133 or the daughter-card engagement slots 113) will allow for the card member (the mother-card member 30 or the daughter-card member 30) to be held coplanar with respect to the middle plane of the card receiving channel where the terminals are set to extend thereinto for being in direct contact with the soldering pads of the card member, thereby establishing an effective electrical connection between the electrical connector 10 and the card member.

While the present invention has been described with reference to preferred embodiments, the description of the invention is illustrative and is not to be construed as limiting the invention. Various modifications to the present invention can be made to preferred embodiments by those skilled in the art without departing from the true spirit and scope of the invention as defined by the appended claims.

What is claimed is:

1. An electrical connector comprising:

an elongated housing defining a lengthwise direction and a transverse direction and having first and second surfaces;

the housing comprising:

a daughter-card receiving channel on said first surface of the housing and extending along said lengthwise direction for receiving a mating edge of a daughter-card member;

a mother-card receiving channel on said second surface of the housing and extending along said lengthwise direction for receiving a mating edge of a mother-card member;

respective daughter-card engagement slots defined on opposed ends of the housing, each said daughter-card engagement slot extending form said first surface and along said transverse direction, each said daughter-card engagement slot laterally separated from said daughter-card receiving channel by a separating wall for receiving therein a respective one of two lateral edge portions of the daughter-card member; and wherein a central line of each said daughter-card engagement slot is aligned with a central line of said daughter-card receiving channel in said lengthwise direction.

2. The electrical connector of claim 1, wherein the housing further includes respective mother-card engagement slots defined on opposed ends of the housing, each said mother-card engagement slot extending from said second surface and along said transverse direction, said mother-card engagement slots being laterally in communication with said mother-card receiving channel for receiving therein respective lateral edge portions of the mother-card member, and wherein a central line of each mother-card engagement slot is aligned with a central line of said mother-card receiving channel.

3. The electrical connector of claim 2, wherein each said mother-card engagement slot is defined by a pair of free extension legs, said pair of free extension legs adapted for cooperatively engaging against opposed surfaces of said respective lateral edge portions of the mother-card member.

4. The electrical connector of claim 2, wherein each said mother-card engagement slot is physically separated from each said daughter-card engagement slot in said transverse direction.

5. The electrical connector of claim 2, wherein a central line of each said mother-card engagement slot is aligned with a central line of each said daughter-card engagement slot in said transverse direction.

6. An electrical connector assembly comprising:

an insulative housing defining opposite first and second mating faces along a front-to-back direction;

a plurality of contacts disposed in the housing and defining opposite first and second mating regions in said front-to-back direction corresponding to said first and second mating faces, respectively;

a first printed circuit board defining a first mating edge region with a plurality of first conductive pads thereon to mate the corresponding first mating regions; and a second printed circuit board defining a second mating edge region with a plurality of second conductive pads thereon to mate the corresponding second mating regions; wherein the first mating edge region is embedded within the housing inside of said first mating face while the second mating edge region is exposed outside of the second mating face; wherein the second printed circuit board further defines a pair of protrusions located by two opposite sides of the second mating edge region and engaged with two opposite towers located at two opposite ends of the housing for holding the second printed circuit board to the housing.

7. The electrical connector assembly as claimed in claim 6, wherein said second mating edge region is rearwardly offset from the protrusions in said front-to-back direction.

8. The electrical connector assembly as claimed in claim 6, wherein the first printed circuit board has said first conductive pads defined on opposite faces of said first mating edge region, said contacts of the housing corresponding to said first mating face are adapted to engage against said first conductive pads on the opposite faces of said first mating edge region.

9. The electrical connector assembly as claimed in claim 6, wherein the second printed circuit board has said second conductive pads defined on opposite faces of said second mating edge region, said contacts of the housing corresponding to said second mating face are adapted to engage against said second conductive pads on the opposite faces of said second mating edge region.

* * * * *